United States Patent [19]

Miller

[11] Patent Number: 4,771,673

[45] Date of Patent: Sep. 20, 1988

[54] GUN PORT ASSEMBLY WITH PIVOTABLY CLOSURE

[75] Inventor: Robert L. Miller, Hacienda Heights, Calif.

[73] Assignee: Armored Transport, Inc., Los Angeles, Calif.

[21] Appl. No.: 32,316

[22] Filed: Mar. 31, 1987

[51] Int. Cl.[4] ..... F41H 5/26

[52] U.S. Cl. ..... 89/36.14; 89/40.03; 49/386

[58] Field of Search ..... 49/386; 89/5, 31, 36.04, 89/36.07, 36.09, 36.14, 40.02, 40.03; 109/11, 59 R, 59 T, 64, 73, 74; 114/175, 176, 178

[56] References Cited

U.S. PATENT DOCUMENTS 1,273,515 7/1918 Makrenos ..... 89/40.03

1,312,897 8/1919 Eiane ..... 89/5

3,566,742 3/1971 Bemiss ..... 89/40.02

4,362,118 12/1982 Koch et al. ..... 114/178

*Primary Examiner*—Stephen C. Bentley

*Attorney, Agent, or Firm*—William W. Haefliger

[57] ABSTRACT

A gun port assembly includes:

(a) an armored closure, (b) structure forming a main port, (c) and a rocker arm pivotably carried by such structure to carry the closure into closing and opening relation to the port in response to pivoting of the arm, (d) and over-center spring mechanism biasing the arm to have a first stable position in which the closure extends in closing relation to the port, and a second stable position in which the closure is spaced away from the port, and the port is open.

9 Claims, 2 Drawing Sheets

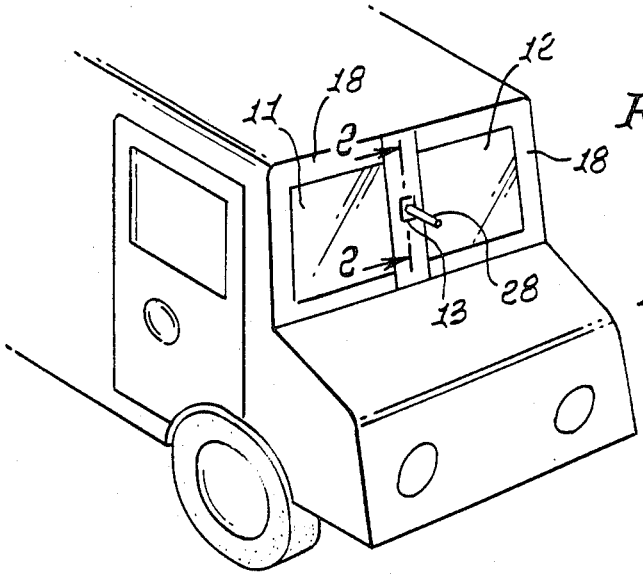
FIG. 1.
FIG. 2.
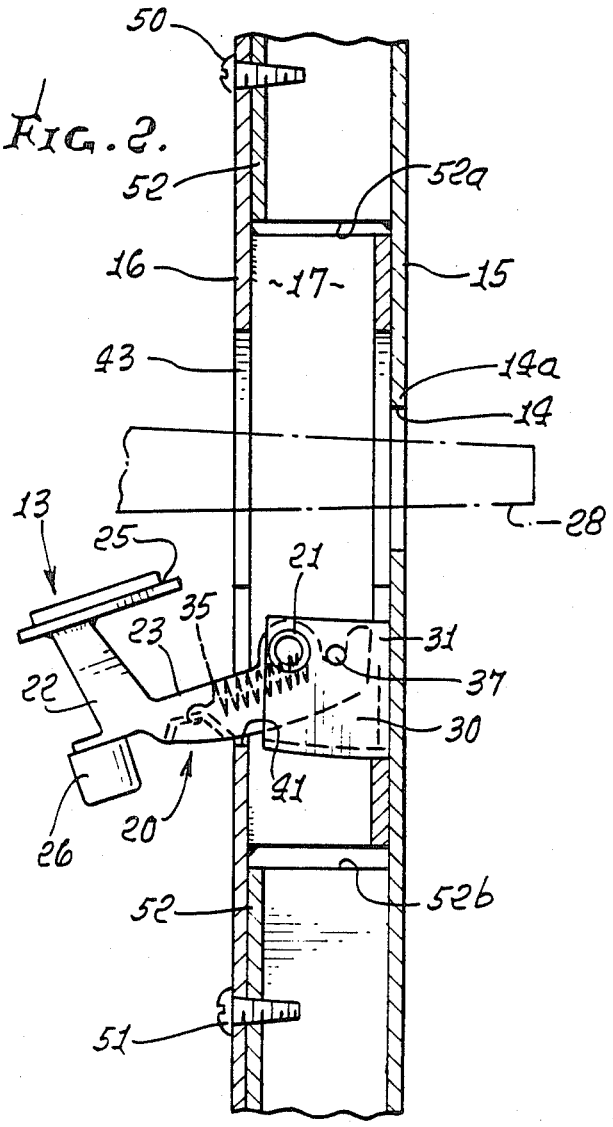
FIG. 3.
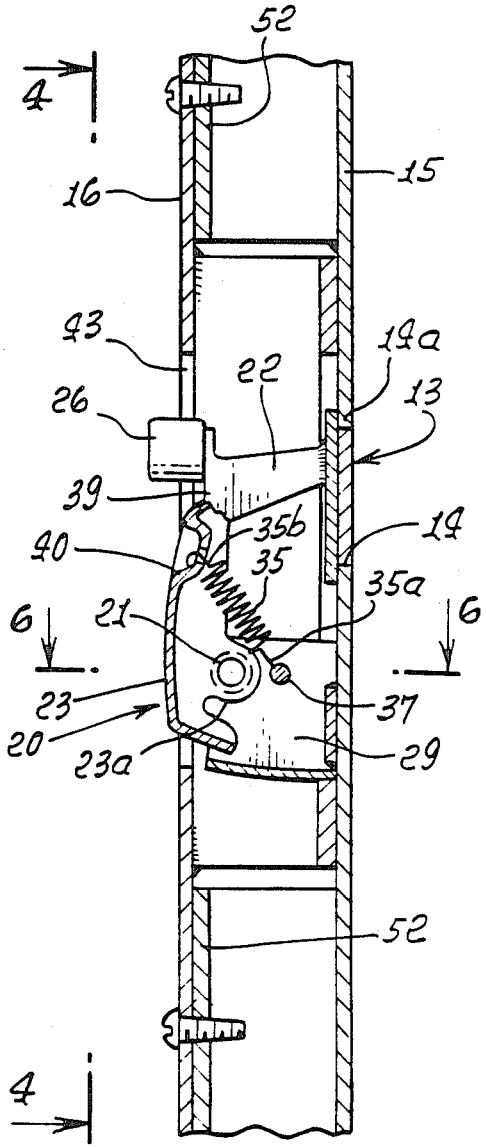

GUN PORT ASSEMBLY WITH PIVOTABLY CLOSURE

BACKGROUND OF THE INVENTION

This invention relates generally to gun ports, and more particularly concerns easily and quickly openable and openable gun port apparatus, useful in defense of armored vehicles and other installations.

Conventional gun ports have closures that require manual elevation, followed by separate insertion or projection of the gun barrel through the open port. This is time consuming and critical, in that the successful defense of an armored vehicle depends upon speed of firing through the port, to ward off attackers. There is need for means to reduce the time of gun port opening manipulation, so that the risk of unsuccessful defense is reduced, particularly as respects the front of the vehicle. Also, there is need for improved construction of gun port mechanism, and including facilitation of widened angularity of gun aiming or positioning, in a port in a front window frame of an armored vehicle.

SUMMARY OF THE INVENTION

It is a major object of the invention to provide an improved gun port mechanism or apparatus, meeting the above needs. Basically, the apparatus of the invention includes:

(a) an armored closure, (b) structure forming a main port, (c) and a rocker arm pivotally carried by said structure to carry the closure into closing and opening relation to said port in response to pivoting of the arm, (d) and over-center spring means biasing the arm to have a first stable position in which the closure extends in closing relation to the port, and a second stable position in which the closure is spaced away from the port, and the port is open.

Such a gun port assembly is typically installed on an armored vehicle having a windshield and associated window frame; and the gun port assembly structure, which includes inner and outer armored walls, is carried by the window frame so that the port, when opened, provides gun barrel access between the interior and exterior of the vehicle, commanding a firing area forwardly of the vehicle.

Typically, the main port is formed in the outer armored wall of the assembly; a pivot for the rocker area is carried between the assembly inner and outer walls; and the inner wall forms an auxiliary port in alignment with said main port, and through which the closure is passed by the rocker arm during pivoting between said first and second stable positions. Further, the rocker arm is advantageously L-shaped and has first and second legs, the closure carried by the first leg, and the second leg rotatable on the pivot, with a handle on the arm openly presented to the rear of the inner wall when the closure extends in closing relative with said main port, for manual grasping to retract the closure away from the main port.

These and other objects and advantages of the invention, as well as the details of an illustrative embodiment will be more fully understood from the following specification and drawings, in which:

DRAWING DESCRIPTION

FIG. 1 is a perspective view showing the invention as applied to the front window frame of an armored vehicle;

FIG. 2 is an enlarged elevation taken on lines 2—2 of FIG. 1, and showing the port open;

FIG. 3 is a view like FIG. 2, showing the port in closed position;

DETAILED DESCRIPTION

Figure 5:
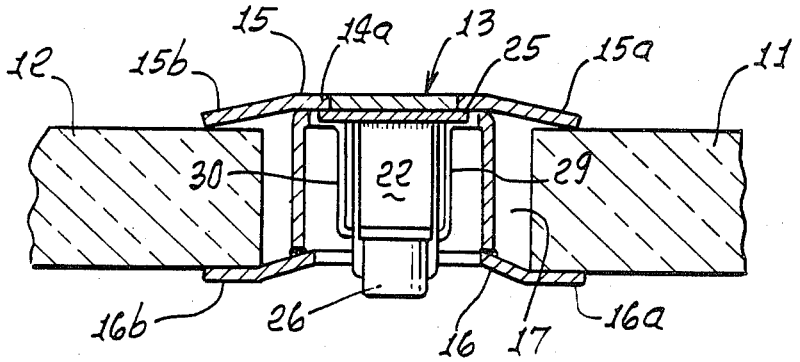
FIG. 5 is a plan view in section on lines 5—5 of FIG. 4.

In the drawings, an armored vehicle 10 has front windshield that includes reinforced glass windows 11 and 12 and a divider zone therebetween. That divider zone is partly or fully occupied by a gun port assembly, as further seen in FIGS. 2–6. As illustrated, the assembly includes an armored closure 13, and structure forming a main port 14 to be opened and closed by the closure 13. Such structure forms or includes upright, armored outer and inner walls or panels 15 and 16 which are spaced apart at 17. The walls 15 and 16 have edge portions **15*a* and 16*a* overlapping and gripping edge extent of window 11; and walls 15 and 16 also have edge portions 15*b* and 16*b* overlapping and gripping edge extent of windows 11 and 12. The walls and panels 15 and 16 typically consist of hardened or alloy steel, to be fully armored, as does closure 13. Frame 18** for the windows is also armored, as is the body of the vehicle.

In accordance with the invention, a rocker arm 20 is pivotally carried, as by a pivot 21 located between walls 15 and 16. The arm includes legs 22 and 23, leg 22 carrying the closure 13 and projecting forwardly in FIG. 3. The closure has a rectangular groove 25 that receives or interfits the periphery **14*a* of the port 14, whereby that periphery acts as a stop to arrest forward pivoting of the closure in main port closing position. The rearward extent of the leg 22 carries a handle or knob 26 to be grasped for pulling the rocker arm rearwardly to open port 14, allowing a gun barrel 28 to be quickly inserted through that opening and fired. Pivot 21 extends laterally in space 17 between two plates 29 and 30 that extend forwardly and rearwardly and are connected to wall 15, as at 31. Also, the leg 23 has lobes 23*a* in space 17 journaled to the pivot 21. Alternatively, the lobes may be joined to the pivot 21, and the latter may be journaled in plates 29 and 30**.

An over-center tension spring means 35 is located in space 17 to bias the rocker arm, whereby that arm has a first stable position in which the closure extends in closing relation to the port 14 (see FIG. 3), and the arm also has a second stable position (see FIG. 2) in which the closure is retracted and spaced away from the port. In the example, the spring 35 has a first end **35*a* connected to a pin 37 extending between plates 29 and 30, forwardly of the pivot, and a second end 35*b* connected to leg 23 at 40 near its junction 39 with leg 22, and above the pivot 21, in FIG. 3. In FIG. 2, the leg engages a shoulder or edge 41 of the inner wall 16, which acts as a stop to limit counterclockwise pivoting of the rocker arm, in FIG. 2**.

The inner wall forms an auxiliary port or opening 43 in alignment with port 14, and larger than the latter, to pass the rocker arm as it pivots back and forth. Edges of the opening 43 appear at **43*a*–43*e* and 41, in FIG. 4**.

Figure 4:
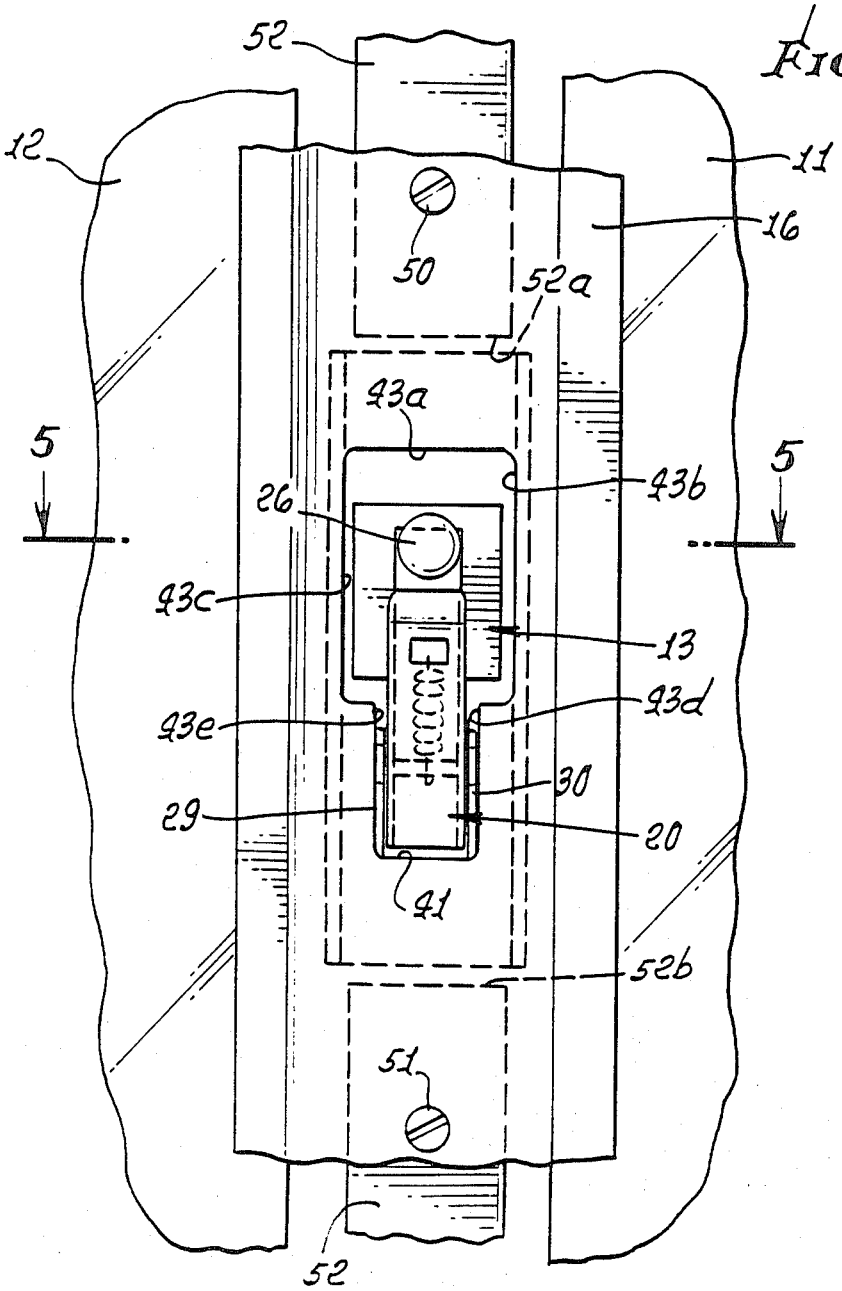
FIG. 4 is a front elevation on lines 4—4 of FIG. 3.
Figure 6:
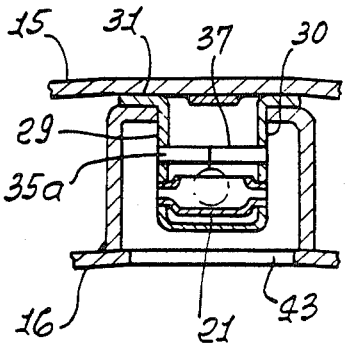
FIG. 6 is a section on lines 6—6 of FIG. 3.

Note also in FIG. 4 that plates 15 and 16 may be attached by fasteners 50 and 51 to a frame strut 52 extending upright between the windows 11 and 12. Strut 52 has vertically spaced ends 52*a* and 52*b* betwen which the rocker arm and closure are movable, as described, in space 17.

In operation, the user can quickly open the port 14 by grasping the handle or knob 26 and retracting the closure by pivoting of arm 20, to a downward stable position, whereby a gun barrel can quickly be thrust through port 14 and fired.

Finally, frame 18 is effectively connected to one or both panels 15 and 16, as via strut 52. Walls 15 and 16 are armored (i.e. hardened steel, for example) as in frame 18.

I claim:

1. In a gun port assembly, the combination comprising:

(a) an armored closure, (b) structure forming, outer and inner upright armored walls which are spaced apart, there being a port formed in said outer wall, (c) and a rocker arm pivotably carried by said structure to carry the closure into closing and opening relation to said port in response to pivoting of the arm, there being a pivot for said rocker arm carried by said structure between said walls, the arm carrying the closure in spaced relation to the pivot, (d) and over-center spring means biasing the arm to have a first stable position in which the closure extends in closing relation to the port, and a second stable position in which the closure is spaced away from the port, and the port is open.

2. The combination of claim 1 including an armored vehicle having a windshield and associated frame, said structure carried by said frame so that said port when opened provides access between the interior and exterior of the vehicle.

3. In a gun port assembly, the combination comprising:

(a) an armored closure, (b) structure forming a main port, (c) and a rocker arm pivotably carried by said structure to carry the closure into closing and opening relation to said port in response to pivoting of the arm, (d) and over-center spring means biasing the arm to have a first stable position in which the closure extends in closing relation to the port, and a second stable position in which the closure is spaced away from the port, and the port is open, (e) said structure forming outer and inner upright armored walls which are spaced apart, said port formed in said outer wall, and there being a pivot for said rocker arm carried by said structure between said walls.

4. The combination of claim 3 wherein the inner wall forms an auxiliary port in alignment with said main port, and through which the closure ispassed by the rocker arm during pivoting between said first and second stable positions.

5. The combination of claim 3 wherein the rocker arm is generally L-shaped and has first and second legs, the closure carried by the first leg, and the second leg rotatable on the pivot, and a handle on the arm openly presented to the rear of the inner wall when the closure extends in closing relation with said main port, for manual grasping to retract the closure away from the main port.

6. The combination of claim 5 including an auxiliary port formed by the inner wall, the handle located proximate said auxiliary port when the closure closes the main port.

7. The combination of claim 6 wherein the L-shaped rocker arm extends substantially completely between said armored walls when the closure closes the main port.

8. The combination of claim 1 wherein the closure defines a peripheral groove that receives the peripheral edge of the main port when the main port is closed by the closure.

9. The combination of claim 3 wherein said inner and outer armored walls have edge portions extending in overlapping mounting relation with armored vehicle front window means.

* * * * *